US009472173B2

(12) United States Patent
Wassermann

(10) Patent No.: US 9,472,173 B2
(45) Date of Patent: Oct. 18, 2016

(54) DEVICE, MOUTHPIECE, AND REED FOR A WIND INSTRUMENT

(71) Applicant: TECHNISCHE UNIVERSITÄT WIEN, Vienna (AT)

(72) Inventor: Johann Wassermann, Vienna (AT)

(73) Assignee: TECHNISCHE UNIVERSITÄT WEIN, Vienna (AT)

( * ) Notice: Subject to any disclaimer, the term of this patent is extended or adjusted under 35 U.S.C. 154(b) by 0 days.

(21) Appl. No.: 14/899,916

(22) PCT Filed: Jun. 25, 2014

(86) PCT No.: PCT/AT2014/050143
§ 371 (c)(1),
(2) Date: Dec. 18, 2015

(87) PCT Pub. No.: WO2014/205471
PCT Pub. Date: Dec. 31, 2014

(65) Prior Publication Data

US 2016/0140937 A1 May 19, 2016

(30) Foreign Application Priority Data

Jun. 25, 2013 (AT) ..... A 50416/2013

(51) Int. Cl.
*G10D 9/02* (2006.01)

(52) U.S. Cl.
CPC ..... *G10D 9/023* (2013.01); *G10D 9/02* (2013.01)

(58) Field of Classification Search
CPC ..... G10D 9/023; G10D 9/02
See application file for complete search history.

(56) References Cited

U.S. PATENT DOCUMENTS

| | | | | |
|---|---|---|---|---|
| 1,413,929 | A * | 4/1922 | Naujoks | G10D 9/02 84/383 R |
| 1,783,824 | A | 12/1930 | Brenner | |
| 2,181,880 | A | 12/1939 | Daniel | |
| 2,224,308 | A * | 12/1940 | MacCaferri | G10D 9/023 84/383 A |
| 2,495,484 | A * | 1/1950 | Schemenauer | G10D 9/02 84/383 R |
| 3,340,759 | A | 9/1967 | Petzke | |
| 3,420,132 | A * | 1/1969 | Backus | G10D 9/023 84/383 A |
| 3,523,481 | A | 8/1970 | Stevens | |
| 2005/0087057 | A1* | 4/2005 | Taillard | G10D 9/02 84/383 R |
| 2009/0301284 | A1 | 12/2009 | Legere et al. | |
| 2016/0140937 | A1* | 5/2016 | Wassermann | G10D 9/023 84/383 A |

FOREIGN PATENT DOCUMENTS

| | | |
|---|---|---|
| DE | 571418 | 3/1933 |
| EP | 1324310 | 7/2003 |
| GB | 626478 | 7/1949 |

* cited by examiner

*Primary Examiner* — Robert W Horn
(74) *Attorney, Agent, or Firm* — Norton Rose Fulbright US LLP

(57) ABSTRACT

The invention relates to a device for a wind instrument, comprising a mouthpiece (1) which encloses a sound chamber (12) and which has a window (2) connected to the sound chamber (12), and comprising a reed (6) which comprises a plastic material, which has a shaft portion (8) connected over its surface to a support (5) of the mouthpiece (1), and a movable free end portion (9) that can be placed on bordering surfaces (4; 4', 4'', 4''') of the window (2). The reed (6) has sealing means (14) on a support surface (10) facing the boundary surfaces (4; 4', 4'', 4''') of the window (2) and/or the mouthpiece (1) has sealing means on at least one of the boundary surfaces (4; 4', 4'', 4''') of the window (2) in order to seal an air flow between the reed (6) and the mouthpiece (1). The invention also relates to a mouthpiece (1) and a reed (6) for such a device.

31 Claims, 2 Drawing Sheets

DEVICE, MOUTHPIECE, AND REED FOR A WIND INSTRUMENT

CROSS-REFERENCE TO RELATED APPLICATIONS

Figure 1A:
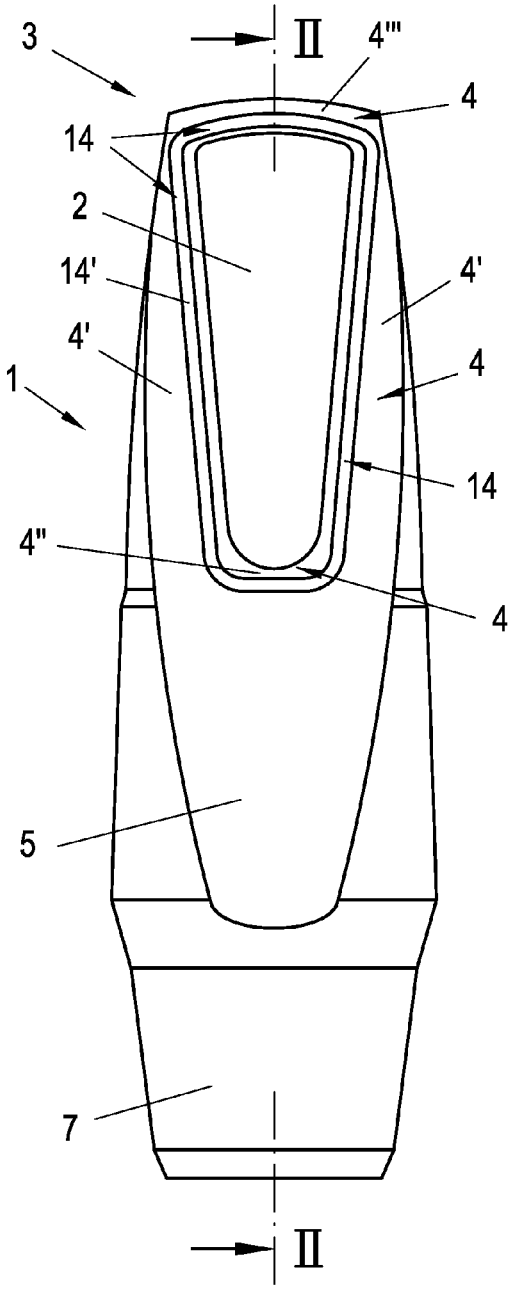

This application is a national phase application under 35 U.S.C. §371 of International Application No. PCT/AT2014/050143 filed 25 Jun. 2014, which claims priority to Austrian Patent Application No. A50416/2013 filed 25 Jun. 2013. The entire contents of each of the above-referenced disclosures is specifically incorporated herein by reference without disclaimer.

The invention relates to a device for a wind instrument, comprising a mouthpiece which encloses a sound chamber and which has a window connected to the sound chamber, and comprising a reed which comprises a plastic material, a shaft portion connected over its surface to a support of the mouthpiece, and a movable free end portion that can be placed on boundary surfaces of the window.

Furthermore, the invention relates to a mouthpiece for a wind instrument, comprising a window connected to a sound chamber of the mouthpiece, and comprising a support for a reed which comprises a shaft portion connectable over its surface to the support, and a movable free end portion that can be placed on boundary surfaces of the window.

Finally, the invention relates to a reed for a wind instrument, the reed comprising a plastic material, comprising a shaft portion connectable over its surface to a support of a mouthpiece and comprising a movable free end portion that comprises a support surface that can be placed on a boundary surface of a window of the mouthpiece.

In the prior art, mouthpieces for wind instruments have been known for some time, using a reed made of a plastic material. Compared to the conventional design made of wood, the plastic reeds are distinguished by a longer service life, lower production costs and comparably low manufacturing tolerances. However, as a disadvantage, the plastic reeds cannot yet achieve the sound quality of reeds made of wood.

In AT 507 515 A1, it was assumed that the poorer sound of plastic reeds was due to the different vibrational behavior.

To improve the sound behavior of the plastic reed, this prior art suggested to reduce the surface of impact on the mouthpiece by recesses. This is to dampen the impact of the reed, to imitate the damping behavior of a wooden reed.

Despite intensive research carried out in connection with the vibrational or damping behavior of such plastic reeds, however, the sound of wooden reeds could not yet be obtained.

The U.S. Pat. No. 1,783,824 A discloses a mouthpiece for wind instruments, in which a reed made of metal or wood is provided. The reed comprises a vibratory portion and a base or mounting portion. To obtain an airtight fit of the reed with the mouthpiece, a flexible material, for example, cork or rubber, is provided on the underside of the mounting portion. Therefore, this prior art describes only a gentle attachment of the reed.

The US 2005/087057 A1 shows a mouthpiece for a wind instrument, in which an insert is provided between a reed and a mouthpiece, to improve the playing characteristics of the wind instrument. The insert extends from the shaft or mounting portion of the reed and into the lateral boundary surfaces of the window. For this purpose, the insert may have tongue portions. The insert may be made of an aluminum alloy or a plastic material. This prior art, however, aims at influencing the vibrational behavior of the reed only.

The U.S. Pat. No. 2,495,484 A shows another mouthpiece for wind instruments, in which a flexible lay-on plate for a conventional reed is provided on the mouthpiece. This prior art likewise tries to influence the sound behavior via the vibrational characteristics.

In connection with a conventional reed, the GB 626,478 also describes a mouthpiece having a different design, in which the reed is spaced apart from the mouthpiece by means of rip-shaped projections. This is to facilitate the production of sounds. Nevertheless, to obtain sufficient air tightness in this design, a flexible plate or a rubber strip is positioned between the reed and the mouthpiece.

As compared to this, it is the object of the invention to reduce or eliminate the disadvantages of the prior art when using a plastic material for the reed. Hence, it is the object of the invention to create a device for wind instruments, a mouthpiece and/or a reed of the above defined type, by means of which the sound behavior of the device is improved.

To achieve this object, the invention provides that the reed has sealing means on a support surface facing the boundary surfaces of the window and/or the mouthpiece has sealing means on at least one of the boundary surfaces of the window in order to seal an air flow between the reed and the mouthpiece.

According to the invention, on the contact surfaces between reed and mouthpiece there are provided sealing means which advantageously cause the air flow to be precisely blocked or unblocked by an opening of the window, which opening remains open during the non-operative state of the reed, once the reed is set into movement and/or vibration to produce tones. Due to the arrangement of sealing means to seal the air flow, the sound quality of the device can essentially be increased, without adversely influencing the moving and/or vibrational characteristics of the reed. The invention is based on the surprising finding that, due to the sealing means on the contact surfaces, the sound characteristics of a wooden reed, which will be moistened during the break-in period and thus allows good sealing of the window upon impingement, can be imitated in an advantageous manner. Thus, according to the invention, the advantages of the plastic reed, in particular including durability, cost-efficient production, and low manufacturing tolerances may be combined with a sound behavior that can be obtained in a wooden reed after the break-in period.

To improve the sealing of the window of the mouthpiece by the reed set into motion and/or vibration, it is favorable if sealing means are provided along at least one lateral boundary surface of the window, that extends essentially in the longitudinal direction of the mouthpiece, preferably along both opposite lateral boundary surfaces of the window. During playing, the reed contacts the lateral boundary surfaces of the window in accordance with the movement and/or frequency of the vibration. Due to the sealing means on the contact surfaces the air flow is precisely blocked or unblocked, depending on the oscillating condition of the reed. The sealing of the window along boundary surfaces alongside the mouthpiece, which will be completely contacted only by the moved and/or oscillating reed, results in an essentially better sound quality in comparison with previous plastic reeds, which lives up to that of high-quality wooden reeds.

In tests concerning the sound quality of the mouthpiece it has additionally turned out to be advantageous if sealing means are provided along a boundary surface of the window, which boundary surface is adjacent to the shaft portion of the reed and extends transversely to the longitudinal direction of the mouthpiece. In this design variant, the contact surfaces between the reed and the mouthpiece, which are designed to be adjacent to the shaft portion of the reed, are provided with sealing means, whereby the sound characteristics of the mouthpiece can be further improved.

According to a preferred embodiment it is further provided that sealing means are provided along a boundary surface of the window, which boundary surface is extending in the area of the tip of the mouthpiece transversely to the longitudinal direction of the mouthpiece. In the non-operative state of the mouthpiece, the reed is in contact over its surface with the support of the mouthpiece, whereby the window of the mouthpiece, apart from a narrow opening, is closed. The remaining free opening has a so-called facing length and a tip opening. The facing length is defined to be the extension of the opening in longitudinal direction of the mouthpiece. The tip opening is defined to be the distance between the free end of the reed and the facing boundary surface of the window. In the non-operative state of the device, the reed is arranged along the facing length and spaced apart from the boundary surfaces of the mouthpiece, while the remaining portions of the reed have their surfaces resting on the support of the mouthpiece. In the preferred embodiment, sealing means are provided on the tip of the mouthpiece adjacent to the tip opening of the mouthpiece, thus obtaining an advantageous sealing in the area of the tip opening.

When sealing means enclose the window of the mouthpiece on all sides, this can facilitate the production of tones within the mouthpiece, which furthermore essentially improves the sound characteristics.

From a manufacturing perspective, it is to be preferred if the sealing means are mounted to the at least one boundary surface of the window. Accordingly, the sealing means can be integrated into the boundary surface of the window, thus obtaining a reliable sealing against the oscillating reed. Advantageously, attaching the sealing means to the stationary contact surfaces of the mouthpiece is particularly stable. In addition, a special durable embodiment can be obtained.

When the sealing means are arranged in a groove-like recess of the boundary surface, advantageously any damage done to the sealing means can be avoided reliably, even after long-time use. Advantageously, in addition, this design is particularly long-lived, since the sealing means within the groove-like recess are subjected to minimal wear only.

To obtain an expedient sealing effect along the contact surfaces between the reed and the mouthpiece, it has proven to be advantageous if the groove-like recess has a width of between 0.1 mm and 2 mm, preferably of between 0.25 mm and 1 mm, in particular essentially 0.6 mm.

In addition, advantageous sealing characteristics can be achieved if the groove-like recess has a depth of between 0.2 mm and 3.2 mm, preferably of between 0.4 mm and 2.0 mm, in particular essentially 1.4 mm.

If the sealing means arranged in the groove-like recess are flush with the adjacent portions of the boundary surface, the vibration of the reed will not be impaired by the sealing means. In this design variant, the vibrational characteristics of the reed are not impaired, wherein due to the sealing means on the contact surfaces the sound characteristics of the mouthpiece can be essentially improved as compared to conventional embodiments.

To obtain special playing characteristics, e.g. to enhance the impact damping or increase the sealing effect, the sealing means may alternatively form an elevation of between 0.02 mm and 0.8 mm, preferably of between 0.05 mm to 0.3 mm, as against an adjacent portion of the boundary surface of the window. In this variant, therefore the sealing means project from the enclosing area of the window.

In accordance with an alternative preferred embodiment of the invention, the sealing means are formed or are effective on one of the support surfaces of the window facing the at least one boundary surface of the window. The sealing means on the reed may replace the sealing means on the boundary surfaces of the window. Of course, alternatively corresponding sealing means can be arranged on both the support surface of the reed as well as on at least one boundary surface of the window.

To seal the oscillating reed, a preferred embodiment provides that the support surface of the reed comprises sealing means, the sealing means being realized as a coating on the plastic material of the reed, the coating consisting of a sealing material different from the plastic material of the reed. Therefore, in this design variant, the plastic material forms the core of the reed, wherein the reed is coated with said sealing means on the support surface. In this design variant, the coating is formed by a sealing material that is different from the plastic material of the sheet. Thus, the sealing material may have better sealing characteristics compared to the core material, whereby the core material in turn may be optimized in terms of the playing or oscillating characteristics. The sealing material may preferably be attached by coating methods known per se in the prior art, e.g. sputter deposition, spin or dip coating, plasma, nano or functional coating, chemical grafting, in particular comprising the steps of photochemical initiation, thermally active initiation, "surface photografting", plasma modification (with oxidizing and bonding), "plasma corona" (attachment of anchor groups for the binding of e.g. silicone resins), or transfer printing on the underside of the reed facing the mouthpiece. The details of these coating methods are known as such in the prior art, so that no further details are necessary. The coating may have a thickness of between 1 μm and 0.5 mm, preferably of between 20 μm and 0.2 mm, in particular essentially 50 μm. Attaching such a thin coating causes an advantageous sealing effect on the oscillating reed, without essentially influencing the playing and/or vibrating characteristics of the reed, which are mainly determined by the plastic material of the reed forming the core in this design variant.

To obtain a sealing effect positively influencing the sound characteristics, it is advantageous if the sealing means are formed by a sealing material having a lower shore A hardness than the plastic material of the reed, the shore A hardness of the sealing material preferably being between 5 and 80, in particular preferably between 10 and 50, even more preferably between 15 and 30, in particular essentially 20.

In the above cited embodiments, it is of advantage if the sealing material of the sealing means is a plastic, preferably Teflon, nylon, a silicone or urethane rubber, nitrile-butadiene-, fluoro-carbon, ethylene-propylene-diene-, acrylate-, methyl-vinyl-silicone rubber, or a thermoplastic elastomer.

In addition, it is favorable if polypropylene, polyethylene or a fiber-plastic compound, in particular with carbon, aramide or glass fibers is provided as plastic material for the reed.

According to an alternative embodiment of the invention, the plastic material of the reed forms the sealing means. In this design variant, the sealing is therefore obtained by means of the plastic material, which is provided on the support surface on the side of the reed facing the sound chamber.

In a preferred variant, the plastic material of the reed forming the sealing means is arranged on a core material different from it, in particular metal. In this variant, the plastic material effecting the sealing is therefore formed as coating of the core material. It is particularly favorable if the core material, for example bronze, is essentially completely embedded in the plastic material composed of one or several layers. Such a reed having a core material and a coating made of plastic material may, in particular, be manufactured in a multi-component injection molding method. Alternatively, one of the above cited coating methods may be applied. The plastic material has good sealing characteristics, at least on the side facing the sound chamber. In this variant, the mechanical characteristics of the reed may essentially be obtained by the core material, in particular metal, and the sealing and damping characteristics by the plastic material enclosing the core material. In this variant, the plastic material forming the sealing means is preferably taken from the group consisting of Teflon, nylon, silicone or urethane rubber, nitrile-butadiene-, fluoro-carbon, ethylene-propylene-diene-, acrylate-, methyl-vinyl-silicone rubber, or a thermoplastic elastomer.

In an alternative variant, the reed is made of the plastic material forming the sealing means. Accordingly, in this variant the reed consists of the plastic material, by which the sealing effect on the support surface is obtained. This can be obtained for example in that the reed has a functionally hydrophilic surface on the support surface, which hydrophilic surface features a particularly good sealing effect. To produce the functionally hydrophilic surface, the reed can be treated at least on the support surface by means of grating with radiation-chemical initiation, thus causing increased moisture absorption on the surface.

In all of the above cited embodiments, it is of advantage if the mouthpiece is made of a non-deformable material, e.g. hardened rubber, ebonite, or acryl at least in the area of the boundary surfaces of the window. Each of the various variants of the sealing means preferably has an essentially lower hardness or a higher smoothness than the material of the mouthpiece, to achieve a better sealing effect as compared to the material of the mouthpiece.

Within the scope of the same inventive concept, the object on which the invention is based is also obtained by a mouthpiece of the above given type, in which at least one boundary surface of the window comprises sealing means.

Finally, the object of the invention is obtained by a reed of the above illustrated type, in which the support surface of the reed comprises sealing means.

Thereby, the same advantages are achieved as in the device described above, so that reference is made to these statements regarding the mouthpiece or reed according to the invention.

Figure 1B:
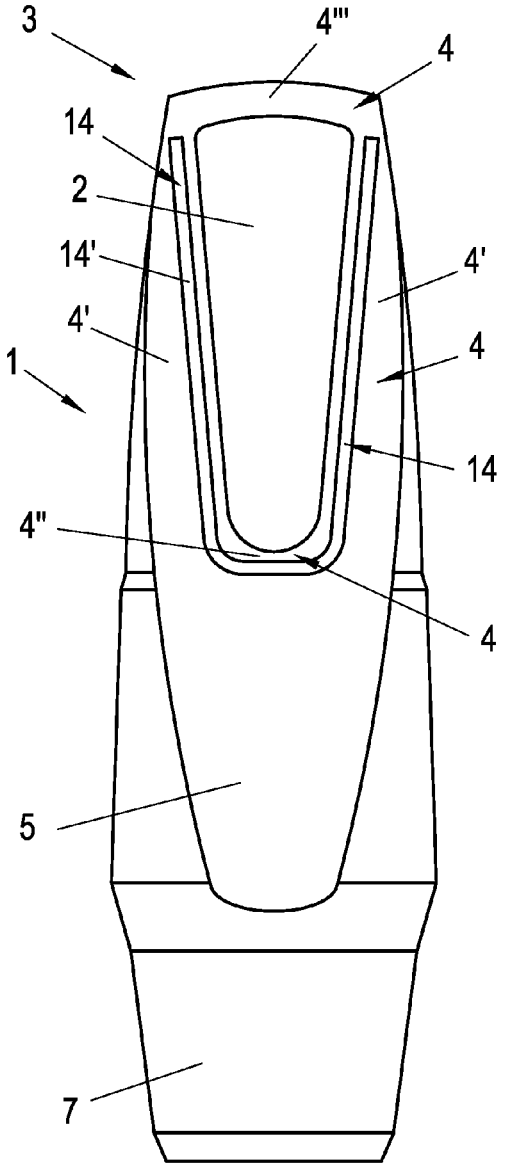
Figure 2:
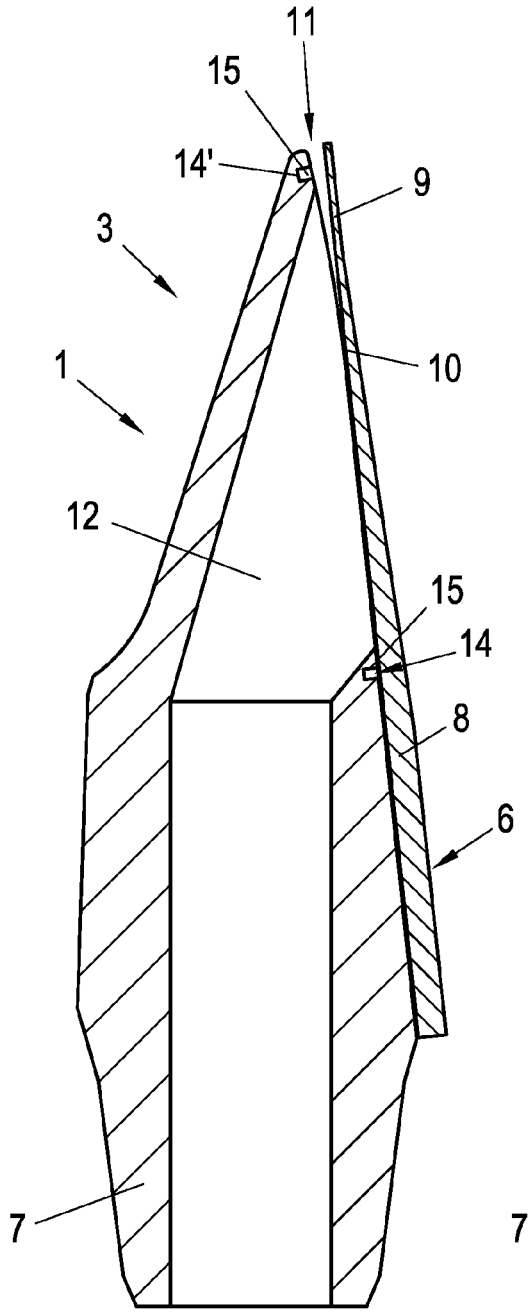
Figure 3:
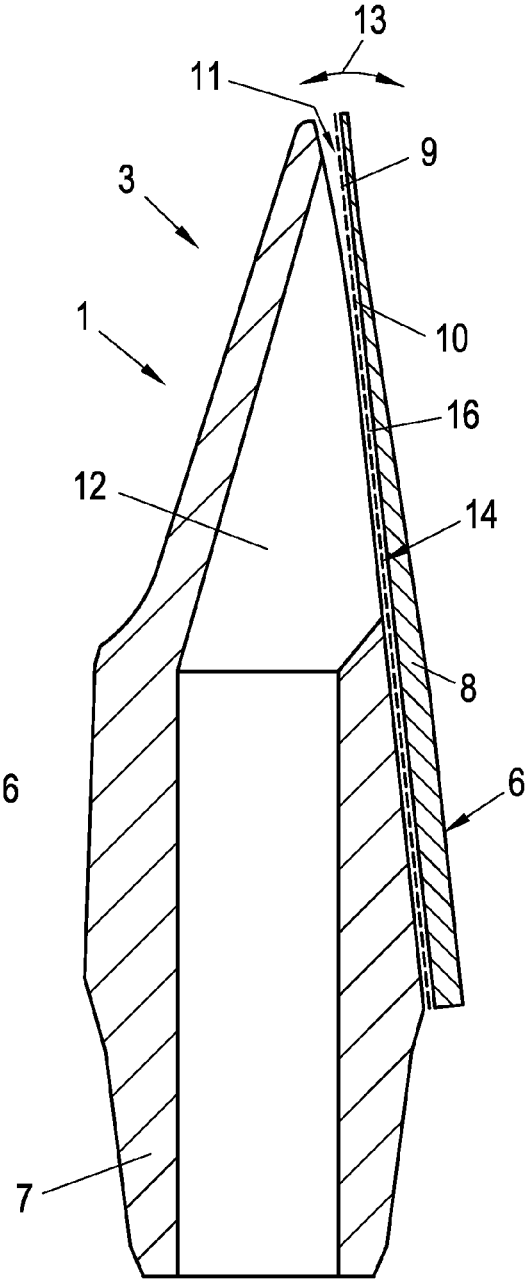

Below, the invention will further be described on the basis of embodiments shown in the drawing, however not limited thereto. The drawing shows as follows:

FIG. 1*a* and FIG. 1*b* each an embodiment according to the invention of a mouthpiece for a wind instrument, in which sealing means are provided on boundary surfaces of a window of the mouthpiece;

FIG. 2 a sectional view according to line II-II in FIG. 1*a*, wherein the mouthpiece is connected to a reed (not shown in FIG. 1*a* or 1*b*);

FIG. 3 a sectional view of an alternative embodiment of the invention, which view corresponds to FIG. 2, in which the sealing means are formed as coating of the reed.

FIG. 1 shows a mouthpiece 1 for a wind instrument, which in the shown variant is part of a clarinet (not shown). The mouthpiece 1 shows an essentially trapezoidal window 2 broadening towards the tip 3 of the mouthpiece 1. The window 2 is enclosed on all sides by boundary surfaces 4 of the mouthpiece 1. On the one hand, the mouthpiece 1 comprises lateral boundary surfaces 4' extending strip-wise in longitudinal direction of the mouthpiece 1. Furthermore, the mouthpiece 1 comprises transversely extending boundary surfaces 4" or 4''' on the narrow sides of the window 2, wherein the boundary surface 4''' is adjacent to the tip 3 of the mouthpiece 1.

As can be also seen from FIG. 1, the mouthpiece 1 comprises an essentially plane support 5 which continues the boundary surfaces 4', 4" of the mouthpiece 1. The support 5 serves the attachment of a reed 6 (not shown in FIG. 1) (cf. FIG. 2). In addition, the mouthpiece 1 comprises a connecting portion 7 to connect the mouthpiece 1 to the wind instrument, which portion in the shown embodiment is formed by a conically converging end portion of the mouthpiece 1 opposite the tip 3. Alternatively, e.g. a screw connection can be provided between the mouthpiece 1 and the wind instrument.

As shown in FIG. 2, the reed 6 comprises a shaft portion 8 comprising a surface resting on the support 5 of the mouthpiece 1 in the mounted state of the reed 6. For attaching the reed 6, fastening means (not shown) well known from the prior art are used. For example, the reed can be mounted to the mouthpiece 1 by a clamp (not shown) which is put around the reed 6 and fixed. Alternatively, a band can be wrapped around the reed 6 (not shown). In the shown embodiment of the mouthpiece, the support 5 is shaped so as to be substantially planar. As an alternative, the support 5 may be shaped so as to be slightly concave, biasing the reed 6 in the mounted state. Both embodiments, however, have in common that the shaft portion 8 of the reed 6 comprises a surface resting on the support 5 in the mounted, clamped state.

As is also shown in FIG. 2, the reed 6 comprises a free end portion 9 which is set into movement and/or vibration to produce tones. The free end portion 9 comprises an essentially plane support surface 10 on the underside, which contacts in sections the lateral boundary surfaces 4' of the mouthpiece 1 in the vibration-free non-operative state of the reed 6. The boundary surfaces 4' are rounded off or are shaped convexly toward the tip 3, so that adjacent to the tip 3 of the mouthpiece 1 a narrow opening 11 is formed between the reed 6 and the facing portions of the boundary surfaces 4' of the mouthpiece 1. For the production of tones, the player produces an air flow which passes through the opening 11 via the window 2 and into a sound chamber 12 of the mouthpiece 1. The sound chamber 12 is formed by a central hollow space of the mouthpiece 1, which hollow space extends from the window 2 up to the connecting portion 7 of the mouthpiece 1.

As indicated in FIG. 3 by an arrow 13, during playing, the reed 6 is set into movement or vibration perpendicularly to its longitudinal plane; in this process, the support surface 10 of the reed 6, including the portions of the support surface 10 which are spaced apart from the mouthpiece 1 in the non-operative state, makes contact with the boundary surfaces 4 of the window 2. Thus the opening 11 will be closed or cleared with the frequency of the oscillation or resulting motion, thus producing the respective tone in combination with the sound chamber 12.

In the shown embodiment, the reed 6 is made of a plastic material. Manufacturing the reed 6 of plastic has many advantages over a conventional design made of wood, in particular including a longer service life and relatively low tolerances in series production. On the other hand, the sound quality of plastic reeds could not yet reach that of wooden reeds, which obtain their optimal sound behavior only after a certain break-in period though.

To make use of the advantages of the plastic reed 6 and simultaneously obtain the sound quality comparable to wooden reeds, the shown embodiment of the device provides sealing means 14 to seal the air flow between the reed 6 and at least one of the boundary surfaces 4; 4', 4", 4'''. Due to the sealing of the contact surfaces between the reed 6 and the boundary surfaces 4, the air flow for sound production can be blocked or unblocked with a high degree of precision, if the reed 6 closes or clears the opening 11 by a movement or in the oscillating state.

As can be seen in FIG. 1*a*, sealing means 14 are provided along both lateral boundary surfaces 4' of the window, thus obtaining a reliable sealing of the opening 11 during the up and down movement of the moved or oscillating reed 3. In addition, sealing means 14 are provided on the boundary surface 4" directly being adjacent to the support 5 of the mouthpiece 1. In the embodiment according to FIG. 1*a*, sealing means 14 are additionally provided along the boundary surface 4''' which extends along the tip 3 of the mouthpiece 1, so that in this design the sealing means 14 enclose the window 2 of the mouthpiece 1 on all sides.

As can be seen in FIG. 1*b*, in this embodiment of the device, it is dispensed with arranging sealing means 14 in the area of the tip 3 of the mouthpiece 1.

According to FIGS. 1, 2 the sealing means 14 are each attached to the corresponding boundary surfaces 4 of the mouthpiece 1. In the design of FIGS. 1, 2 the sealing means 14 are formed by a sealing material 14' which is arranged in a groove-like recess 15. Depending on the design, the groove-like recess 15 with the sealing material 14' accommodated therein extends along one or several boundary surfaces 4; 4', 4", 4''' of the mouthpiece 1. The groove-like recess 15, for example, has a width of essentially 0.6 mm and a depth of essentially 1.4 mm. The sealing material 14' within the groove-like recess 15 is flush with the neighboring portions of the pertinent boundary surfaces 4; 4', 4", 4'''. Advantageously, thus the movability of the oscillating reed 6 is not impaired by the provision of the sealing material 14'. For the sealing material 14' to precisely fit flush with the plane of the pertinent boundary surfaces 4; 4', 4", 4''', the mouthpiece 1 can be provided during manufacturing with the sealing material 14', prior to the mouthpiece 1 provided with the sealing material 14' being given the desired geometry, e.g. by grinding.

To obtain special playing characteristics (e.g. increased impact damping) or to increase the sealing effect, the sealing means can have an elevation of between 0.02 mm and 0.8 mm, preferably of between 0.05 and 0.3 mm, against the surface (not shown) accommodating the sealing means 14.

The sealing material 14' of the sealing means 14 comprises a lower shore A hardness than the plastic material of the reed 6, thus obtaining the sealing effect on the contact surfaces between the reed 6 and the mouthpiece 1. For example, the sealing material 14' can have a shore A hardness of essentially 20. For example, a silicone material is suited for this. In the design according to FIG. 1, 2, as a plastic material of the reed 6, polypropylene, polyethylene, a carbon-, aramide- or glass-fiber compound may be provided, for instance. Accordingly, the sealing material 14' of the sealing means 14 has a lower shore A hardness than the material of the mouthpiece 1 in the area of the boundary surfaces 4, which e.g. may be hardened rubber, ebonite, or acryl.

As can be seen from FIG. 3, the sealing means 14 according to an alternative embodiment are formed on the support surface 10 of the reed 6, which surface is made to contact the boundary surfaces 4 of the window 2 by means of movement and/or in the oscillating state.

In the design according to FIG. 3, the support surface 10 of the reed 6 has a coating 16 made of the sealing material 14', which differs from the plastic material of the remaining reed 6. To form the coating 16, the sealing material 14' is applied to the underside of the reed 6 by means of known surface or thin-film methods, such as by multi-component injection molding, sputter deposition, spin or dip coating, plasma, nano or functional coating. Preferably, the coating 16 essentially extends over the entire underside of the reed 6. The sealing material 14' may be formed accordingly regarding the design of FIGS. 1, 2.

According to an alternative embodiment, the plastic material forms the sealing means 14 on the support surface of the reed 6. On the one hand, the plastic material of the reed 6 forming the sealing means 14 can be arranged on a core material different from this, e.g. bronze (not shown). The plastic used is to meet the requirements made to the desired modulation capacity of the air flow by the musician as well as to achieve the sealing function on the contact surfaces.

Alternatively, the reed 6 can be made of the plastic material forming the sealing means 14. For this purpose, the reed 6 made of the plastic material can have a functionally hydrophilic surface on the support surface (not shown), for example.

The invention claimed is:

1. A device for a wind instrument, comprising:

a mouthpiece enclosing a sound chamber, a window defined by boundary surfaces connected to the sound chamber, a tip, and a longitudinal direction; and a reed comprising a plastic material, a shaft portion connected over its surface to a support of the mouthpiece, and a movable free end portion that can be placed on the boundary surfaces;

wherein the reed comprises a seal on a support surface facing the boundary surfaces and/or the mouthpiece comprises a seal on at least one of the boundary surfaces.

2. The device of claim 1, wherein the seal is comprised on at least one lateral boundary surface of the window that is substantially in the longitudinal direction of the mouthpiece.

3. The device of claim 2, wherein the seal is comprised on two opposing lateral boundary surfaces of the window.

4. The device of claim 1, wherein the seal is comprised along a boundary surface of the window that is adjacent to the shaft portion of the reed that is transverse to the longitudinal direction of the mouthpiece.

5. The device of claim 1, wherein the seal is comprised along a boundary surface of the window that is transverse to the longitudinal direction of the mouthpiece in an area of the tip of the mouthpiece.

6. The device of claim 1, wherein seal encloses the window of the mouthpiece on all sides.

7. The device of claim 1, wherein the seal is attached to at least one boundary surface of the window.

8. The device of claim 7, wherein the seal is arranged in a groove-like recess of the boundary surface.

9. The device of claim 8, wherein the groove-like recess has a width of between 0.1 mm and 2 mm.

10. The device of claim 9, wherein the groove-like recess has a width of between 0.25 mm and 1 mm.

11. The device of claim 10, wherein the groove-like recess has a width of substantially 0.6 mm.

12. The device of claim 8, wherein the groove-like recess has a depth of between 0.2 mm and 3.2 mm.

13. The device of claim 12, wherein the groove-like recess has a depth of between 0.4 mm and 2.0 mm.

14. The device of claim 13, wherein the groove-like recess has a depth of substantially 1.4 mm.

15. The device of claim 8, wherein the seal arranged in the groove-like recess is flush with an adjacent portion of the boundary surface.

16. The device of claim 8, wherein the seal is elevated between 0.02 mm and 0.8 mm relative to an adjacent portion of the boundary surface.

17. The device of claim 1, wherein the seal is elevated between 0.05 and 0.3 mm relative to the adjacent portion of the boundary surface.

18. The device of claim 1, wherein the support surface of the reed comprises a seal further defined as a coating of a material on a plastic material of the reed, wherein the coating material is different from the plastic material of the reed.

19. The device of claim 1, wherein the seal is of a material having a lower shore A hardness than a plastic material of the reed, wherein the shore A hardness of the seal material is between 5 and 80.

20. The device of claim 19, wherein the shore A hardness of the sealing material is between 10 and 50.

21. The device of claim 20, wherein the shore A hardness of the sealing material is between 15 and 30.

22. The device of claim 21, wherein the shore A hardness of the sealing material is substantially 20.

23. The device of claim 1, wherein the seal is comprised of a plastic.

24. The device of claim 23, wherein the plastic is Teflon, silicone, nitrile-budadiene-, fluoro-carbon-, ethylene-propylene-diene, acrylate-, methyl-vinyl-silicone rubber, or a thermoplastic elastomer.

25. The device of claim 1, wherein the plastic material of the reed comprises polypropylene, polyethylene, or a fiber-plastic compound.

26. The device of claim 25, wherein the reed further comprises carbon-, aramide- or glass-fibers.

27. The device of claim 1, wherein the plastic material of the reed forms the seal.

28. The device of claim 27, wherein the plastic material of the reed forming the seal is arranged on a core material different from the plastic material.

29. The device of claim 28, wherein the core material comprises metal.

30. A mouthpiece for a wind instrument comprising:

a sound chamber enclosed by the mouthpiece;

a window connected to the sound chamber of the mouthpiece defined by boundary surfaces;

a support for a reed that comprises a shaft portion connectable over a surface to the support and a movable free end portion that can be placed on the boundary surfaces of the window; and a seal comprised on at least one boundary surface of the window.

31. A reed for a wind instrument comprising:

a plastic material;

a shaft portion connectable over to a support of a mouthpiece;

a movable free end portion comprising a support surface which can be placed on a boundary surface of a window of the mouthpiece; and a seal on the support surface of the reed.

* * * * *